United States Patent [19]

Schillinger

[11] 4,260,333

[45] Apr. 7, 1981

[54] METHOD AND APPARATUS FOR CONTROLLING A FUEL INJECTION SYSTEM

[75] Inventor: Rainer Schillinger, Stuttgart, Fed. Rep. of Germany

[73] Assignee: Robert Bosch GmbH, Stuttgart, Fed. Rep. of Germany

[21] Appl. No.: 15,997

[22] Filed: Feb. 28, 1979

[30] Foreign Application Priority Data

Mar. 1, 1978 [DE] Fed. Rep. of Germany ..... 2808731

[51] Int. Cl.[3] ..... F04B 49/06

[52] U.S. Cl. ..... 417/45; 123/458; 123/497; 417/53; 417/251

[58] Field of Search ..... 417/251, 2, 44, 45, 417/18, 19, 20, 244, 38, 53; 123/32 EA, 139 E, 139 AN, 458, 497

[56] References Cited

U.S. PATENT DOCUMENTS

| | | | |
|---|---|---|---|
| 3,584,977 | 6/1971 | Coleman et al. | 417/2 X |
| 3,669,080 | 6/1972 | Monpetit | 123/139 E X |
| 3,692,430 | 9/1972 | Timmons | 417/44 X |
| 3,827,409 | 8/1974 | O'Neill | 123/32 EA |
| 3,882,861 | 5/1975 | Kettering et al. | 417/44 X |
| 4,112,901 | 9/1978 | Chapin et al. | 123/139 E |

*Primary Examiner*—Carlton R. Croyle
*Assistant Examiner*—Edward Look
*Attorney, Agent, or Firm*—Edwin E. Greigg

[57] ABSTRACT

A method and an apparatus for operating a fuel supply system, in particular a fuel injection system, in which a fuel supply pump continuously supplies fuel and wherein the excess fuel not required for injection is returned to the fuel reservoir. In order to reduce the average operating power of the pump and thus reduce the average amount of fuel returned to the tank, thereby reducing undesirable temperature increases of the fuel in the reservoir, the system fuel pressure is monitored and maintained at a value substantially equal to a reference value. The electrical power of the fuel supply pump is altered continuously so as to maintain the fuel system pressure at the reference level.

8 Claims, 3 Drawing Figures

METHOD AND APPARATUS FOR CONTROLLING A FUEL INJECTION SYSTEM

FIELD OF THE INVENTION

The invention relates to a method and an apparatus for controlling the operation of a fuel supply pump associated with a fuel injection system. More particularly, the invention relates to controlling the output pressure of a fuel supply pump so as to adapt the pump volume to the varying needs of the engine, thereby preventing excessive pumping power and excessive circulation of fuel back to the supply tank.

BACKGROUND OF THE INVENTION

In known fuel injection systems, the fuel supply devices, i.e., fuel supply pumps, which are normally electric pumps, are so dimensioned as to be able to supply sufficient fuel for any engine condition, including a full-load (open throttle) operation. However, the average effective fuel quantity is substantially less than the maximum so that the unneeded fuel is returned to the fuel tank. As the fuel is subjected to circulation through the injection system, it undergoes substantial heating so that, after its return to the fuel tank, the fuel in that tank also becomes heated. This heating leads to evaporation of fuel components with low boiling point and the generation of bubbles in the subsequent passage through the fuel supply pump in which there exists a relative vacuum that enhances the formation of such bubbles. Furthermore, the heating of the fuel in the tank tends to increase the evaporation losses.

It is another distinct disadvantage of the known fuel supply systems that the electric fuel pump operates at full volume and power even when the engine is idling or is operating in the partial-load domain. Accordingly, the life expectancy of the fuel pump is reduced. Furthermore, the operating power, i.e., the electric current supplied to the electric fuel supply pump, is much higher than necessary for average engine operation as is the generation of pump noise.

OBJECT AND SUMMARY OF THE INVENTION

It is thus a principal object of the present invention to provide a fuel injection system in which the fuel quantity supplied by the electric fuel pump of a fuel management system is continuously adapted to the fuel actually used by the engine. It is an associated object of the invention to substantially reduce the quantity of fuel to be returned to the fuel tank in normal engine operation. Still another object of the invention is to provide a fuel supply system which reduces the average electric power supplied to the fuel pump and the average noise generation.

These and other objects are attained according to the invention by providing a fuel management system in which the electric fuel pump is operated at variable power under the control of a comparative control system which senses the prevailing system fuel pressure and compares that value to a reference value. When the system pressure varies from the reference pressure, the controller generates an output datum which is used to vary the electric input voltage for the fuel supply pump and thus adapt the output power of the pump to the required level.

It is a distinct advantageous feature of the invention that the reduced average fuel flow results in a reduced circulation of fuel and, accordingly, a relatively lower transfer of heat to the fuel reservoir. This reduction of reservoir temperature in turn results in reduced fuel gasification and fuel loss as well as in enhanced fuel transport due to the absence of bubbles.

Another advantage of the invention is that the reduced average power of the pump increases its life expectancy and the life of the armature brushes.

It is an advantageous feature of the invention that the system pressure is maintained by a fixed throttle rather than by a variable piston-type pressure controller as has heretofore been the custom. Still another advantageous feature of the invention is that the pressure transducer delivers its signal to a comparator that adjusts the electric pump power by changing the input voltage, for example by periodic cycling of the input voltage.

The invention will be better understood as well as further objects and advantages thereof become more apparent from the ensuing detailed description of a preferred exemplary embodiment taken in conjunction with the drawing.

DESCRIPTION OF THE PREFERRED EMBODIMENT

Preliminary Considerations

The method and apparatus to be described below are applicable in principle for any type of fuel management system of an internal combustion engine in which the fuel supply always exceeds the required amount so that a certain fraction of the supplied fuel will be normally returned to the fuel container.

Figure 1:
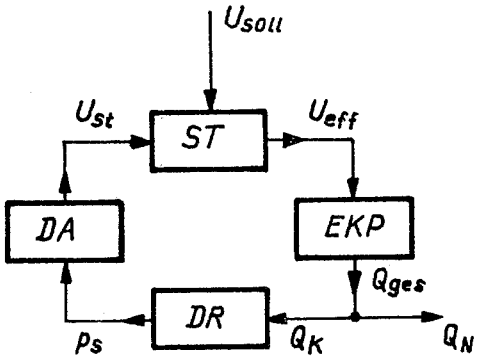
FIG. 1 is a block diagram of the overall disposition of elements in a fuel supply system according to the invention.
Figure 2:
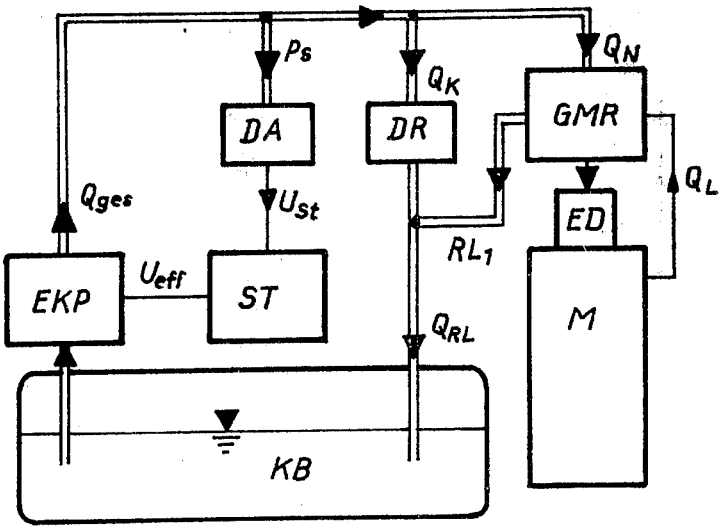
FIG. 2 is a detailed block diagram of the elements in the fuel management system.

This feature is often found in fuel injection systems in which an electric fuel supply pump operates at maximum output power and delivers fuel from a fuel reservoir to the mixture preparation system or the injection valves or nozzles. The method and apparatus to be described below apply to any such system of which the system illustrated in FIG. 1 is an illustrative example. In that figure an electric fuel pump EKP delivers a quantity of fuel Q which is divided between a quantity $Q_N$ needed by the engine and a quantity $Q_K$ to be returned to the fuel reservoir. The fluctuations in the quantity $Q_N$ result in compensatory fluctuations in the quantity $Q_K$ which in turn cause fluctuations in the system pressure $P_s$. These fluctuations are detected by an appropriate pressure transducer DA that delivers an output signal $U_{St}$ which is compared in a comparator ST with a reference value. The comparator ST then delivers an electric signal, for example an electric voltage $U_{eff}$ which determines the operating speed and power of the electric fuel pump. The operating voltage of the electric fuel pump is thus subject to continuous changes depending on the variable amount of fuel $Q_N$ needed by the engine. The operating voltage for the electric fuel pump may be varied by changing its amplitude or by cycling, i.e., by periodic interruption. The reference voltage $U_s$ applied to the controller ST is a measure of the desired fuel system pressure, i.e., the input pressure to the fuel mixture control system. The system pressure $P_s$ is detected in the vicinity of a fixed throttle DR through which a constant quantity of fuel $Q_K$ passes when the system pressure also remains constant. Accordingly, the total quantity of fuel delivered by the fuel pump divides into two separate streams according to the following equation $$Q_T = Q_K + Q_N$$

in which $Q_N$ is the amount of fuel which is used by the mixture preparation system labeled GMR in FIG. 2 and which eventually flows to the fuel injection valves or nozzles ED which deliver it to the motor M. $Q_L$ represents a signal corresponding to the air quantity aspirated by the engine. The signal $Q_L$ is processed by the fuel mixture control system for correctly determining the fuel quantity administered to the engine.

DETAILED DESCRIPTION OF THE EMBODIMENT

FIG. 2 is an illustration of a system in which the method of the invention is embodied. In this system, the fixed throttle DR is connected in parallel with the fuel users (the mixture control system GMR and the injection nozzles ED). If the system pressure $P_s$ is constant, a constant fuel quantity $Q_K$ flows through the throttle DR. However, when the fuel user, (namely the mixture controller GMR and the injection nozzles ED) vary the amount of fuel $Q_N$, this change is initially accompanied by a change in the system pressure $P_s$ and a change in the fuel quantity $Q_K$ passing through the fixed throttle DR. The change in the pressure $P_s$ is detected by a pressure transducer DA which produces an output signal $U_{St}$ that is fed to one input of the controller ST. After the comparison of the input signal $U_{St}$ with a reference value $U_{ref}$, the controller ST generates an output voltage $U_{eff}$ which is applied to the electric fuel pump in the sense of counteracting the detected change in the system pressure $P_s$ so as to maintain the latter constant. The change in the operating voltage for the fuel pump results in a changed pump speed in the sense that, when the system pressure $P_s$ drops, the effective operating voltage $U_{eff}$ of the pump is increased and vice versa. The changes in the operating speed of the pump result in a change of the total fuel quantity $Q_T$ which restores the original and nominal system pressure $P_s$ in a closed-loop system.

The quantity of fuel which is returned to the fuel reservoir KB is thus the sum of the quantity flowing through the throttle DR which changes only very slightly within the control range of the system and a second component which flows from the fuel mixture control system GMR back to the tank through the line $RL_1$. The total quantity of fuel returned to the tank is thus $Q_{RL}$.

In order to obtain satisfactory operation of this control system, it is advantageous if the characteristic operating curve of the controller ST is such that the output signal responds sharply to even very small changes of the system pressure $P_s$ so that the pump voltage $U_{eff}$ is changed substantially as a function of the changing actual value $U_{St}$. It is a further advantageous feature of the invention to place the fixed throttle DR relatively close to the mixture preparation system GMR so as to prevent the occurrence of pressure fluctuations due to flow resistances which cannot be corrected.

Figure 3:
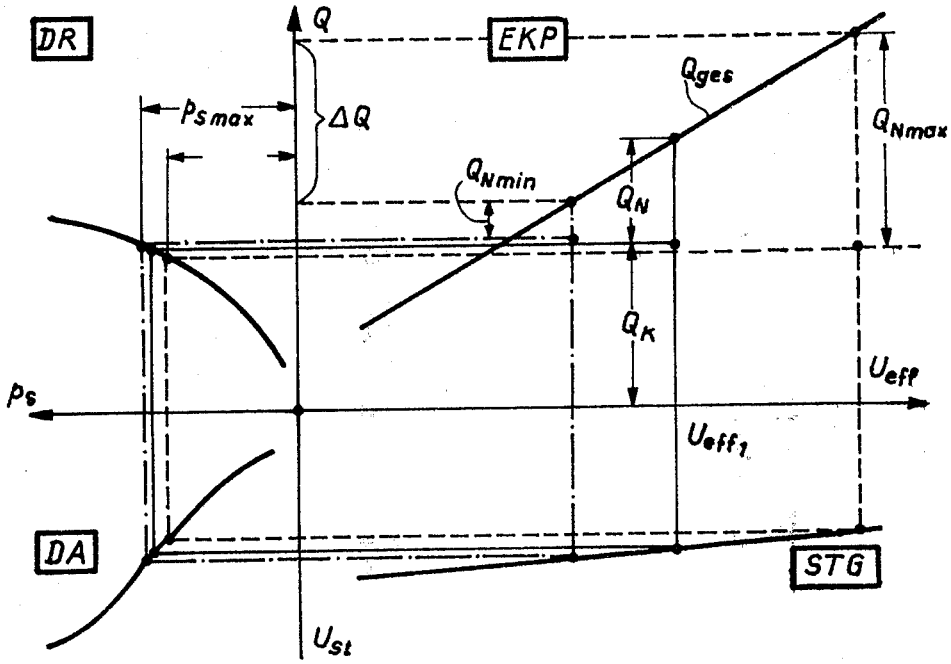
FIG. 3 is a set of diagrams illustrating the characteristics of the various elements of the fuel management system according to the invention.

FIG. 3 is a set of diagrams which illustrate the behavior and function of the control system according to the invention. Each of the four quadrants of the coordinate system illustrated in FIG. 3 shows the characteristic operating curve of one major element of the control system of FIG. 2. In particular, the first quadrant illustrates the operating curve of the electric fuel supply pump EKP and shows the quantity of fuel Q delivered as a function of operating voltage $U_{eff}$. The second quadrant in the counterclockwise sense shows the operating curve of the fixed throttle DR and illustrates the flow of fuel through the throttle as a function of the inlet pressure $P_s$. The third quadrant of the diagram in FIG. 3 illustrates the characteristic curve of the pressure transducer DA and shows its output voltage $U_{St}$ as a function of the system pressure $P_s$. The fourth quadrant of the diagram illustrates the sensitive response of the control system STG as a function of the value of the input variable $U_{St}$ which corresponds to the prevailing system pressure $P_s$.

A study of the diagram of FIG. 3 shows that, even when the fuel quantity $Q_K$ which flows through the fixed throttle DR remains substantially constant, there are substantial differences in the controlled effective fuel quantity $Q_N$ used by the engine which may vary between the minimum value $Q_{Nmin}$ and a maximum value $Q_{Nmax}$. The difference is $\Delta Q$ which becomes the input range for the control system and its magnitude is quantitatively almost the same as the amount of fuel which is unaffected by the control system, i.e., that given by the sum of $Q_K$ and the minimum used fuel quantity $Q_{Nmin}$. This substantial control range is obtained in spite of very slight variations of the system pressure from the desired value $P_s$.

The analytical form of the characteristic curves shown in FIG. 3 is given below.

$$Q_T = K_1 \cdot U_{eff} + K_2 \cdot U_{effo} \quad \text{(EKP)}$$

$$P_s = K_3 \cdot Q_K^2 \quad \text{(DR)}$$

$$U_{St} = K_4 \cdot P_s + K_5 \cdot P_{so} \quad \text{(DA)}$$

$$U_{eff} = K_6 \cdot U_{Sto} - K_7 \cdot U_{St} \quad \text{(ST)}$$

In the simplest case, the controller ST may be an operational amplifier one of whose inputs receives a constant reference voltage $U_{soll}$ which corresponds to the nominal system pressure and the other of its inputs receives the output voltage $U_{St}$ delivered by the transducer DA. The output of this amplifier would then be a voltage that fluctuates about an average value. However, it is advantageous and desirable if the effective average voltage is obtained by cycling the output voltage of the controller ST, i.e., by varying its duty cycle. The foregoing relates to a preferred exemplary embodiment of the invention, it being understood that other embodiments and variants thereof are possible within the spirit and scope of the invention.

What is claimed and desired to be secured by Letters Patent of the United States is:

1. A method for controlling the operation of a fuel injection system, said system including a fuel reservoir, a fuel mixture controller, at least one fuel injection means fed by said controller, a fuel supply pump responsive to electric power for pumping fuel from said reservoir to said fuel mixture controller and a fuel return line for carrying excess fuel not used by said fuel mixture controller back to said fuel reservoir and said method comprising the steps of:

monitoring an actual fuel pressure prevailing near an inlet of said fuel injection means;

converting said actual fuel pressure into a corresponding voltage signal;

comparing said actual (fuel pressure) voltage signal with a reference (pressure) signal; and altering an effective supply voltage to said fuel supply pump thereby altering its operating characteristics so as to maintain said actual fuel pressure substantially equal to said reference signal; whereby the average amount of fuel returned through said fuel return connected to said fuel reservoir is reduced as compared with constant full power operation of said fuel supply pump.

2. A method according to claim 1, wherein said step of altering the operating characteristics of said fuel supply pump responsive to electric power and includes changing the effective supply voltage of said fuel supply pump.

3. A method according to claim 2, wherein the supply voltage for said fuel supply pump is variably changed by cyclic interruption of an otherwise constant supply voltage in dependence on the fuel quantity required to maintain said reference pressure.

4. A method according to claim 1, wherein said fuel return line includes a fixed flow throttle and wherein said actual fuel pressure is monitored directly upstream of said fixed flow throttle.

5. A method according to claim 4, wherein said fixed throttle lies in parallel with a fuel mixture controller and its downstream side is joined to said fuel return line.

6. A fuel injection system including a fuel reservoir, a fuel mixture controller, at least one fuel injection means fed by said controller, a fuel supply pump responsive to electric power for pumping fuel from said reservoir to said fuel mixture controller and a fuel return line for carrying excess fuel not used by said fuel mixture controller back to said fuel reservoir and wherein the improvement comprises:

a pressure transducer for generating a first signal related to the actual fuel pressure prevailing in said fuel injection system upstream of said fuel mixture controller; and a control device for comparing said first signal with a second signal related to a reference value of fuel pressure and for altering the electric power supplied to said fuel supply pump so as to maintain said actual fuel pressure substantially equal to said reference fuel pressure.

7. An apparatus according to claim 6, further comprising a fixed throttle the upstream side of which is connected within said fuel injection system adjacent to the inlet of said fuel mixture controller and the outlet of said fixed throttle is connected to said fuel return line, and wherein said pressure transducer is used to measure the pressure drop across said fixed throttle.

8. An apparatus according to claims 6 or 7, wherein the response curve of said control device is such that relatively small changes in the fuel pressure result in relatively large changes of the effective electrical potential supplied to said fuel supply pump.

* * * * *